US006460217B2

(12) United States Patent
Fukushima et al.

(10) Patent No.: US 6,460,217 B2
(45) Date of Patent: Oct. 8, 2002

(54) ELECTRIC CLEANING DEVICE

(75) Inventors: Sadao Fukushima, Hyogo-ken (JP); Jun Yoshida, Himeji (JP); Akihiro Morita, Kakogawa (JP); Hirotaka Shikano, Kasal (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/759,033

(22) Filed: Jan. 12, 2001

(65) Prior Publication Data

US 2001/0009050 A1 Jul. 26, 2001

(30) Foreign Application Priority Data

Jan. 20, 2000 (JP) ..... 2000-012220

(51) Int. Cl.[7] ..... A47L 9/22; A47L 5/14
(52) U.S. Cl. ..... 15/346; 15/412
(58) Field of Search ..... 15/346, 412

(56) References Cited

U.S. PATENT DOCUMENTS 2,226,630 A * 12/1940 McCord ..... 15/346 X
3,268,942 A * 8/1966 Rossnan ..... 15/402 X
3,484,890 A * 12/1969 Case ..... 15/346
3,694,848 A * 10/1972 Alcala ..... 15/346
6,237,188 B1 * 5/2001 Takemoto et al. ..... 15/346
6,245,159 B1 * 6/2001 Deng ..... 15/346 X
6,245,915 B1 * 6/2001 Nakai et al. ..... 15/346

FOREIGN PATENT DOCUMENTS

| | | | |
|---|---|---|---|
| CA | 977910 | * 11/1975 | ..... 15/346 |
| DE | 2218351 | * 11/1973 | ..... 15/346 |
| DE | 3010130 | * 9/1981 | ..... 15/346 |
| DE | 4135406 | * 5/1992 | ..... 15/346 |

* cited by examiner

*Primary Examiner*—Chris K. Moore
(74) *Attorney, Agent, or Firm*—Darby & Darby

(57) ABSTRACT

An electric cleaning device circulates exhaust air from an electric blower to a floor intake tool. The exhaust air passes through an exhaust guide, formed as one element, in a main cleaning device unit from the electric blower through a hose to the floor intake tool. The exhaust guide is a resilient unitary resin part with sufficient resilience to permit compression for installation. The springback of the exhaust guide seals the exhaust path against leakage.

4 Claims, 18 Drawing Sheets

ELECTRIC CLEANING DEVICE

BACKGROUND OF THE INVENTION

The present invention relates to an exhaust-circulating (circulating) electric cleaning device (vacuum cleaner) that circulates exhaust air from an electric blower in a main cleaning device unit to a floor intake tool through a hose or a pipe.

In Japanese patent application number 11-163986, the present applicant discloses an electric cleaning device in which a circulation path is formed by a combination of elements which include a cover on a lower portion of a main unit case. Exhaust air from an electric blower in a main cleaning device unit is circulated through the circulation path to a floor intake tool. The exhaust air is guided to a rotating brush in the floor intake tool. Dust from the surface to be cleaned is agitated and loosened by the rotating brush, and then drawn up and sucked in by the reduced pressure in the floor intake tool.

However, the air pressure of the exhaust flowing through the exhaust path is higher than atmospheric pressure. Thus exhaust may leak from gaps between elements forming the exhaust path. The leaking air can cause the dust on the floor surface or carpet, located away from the floor intake tool, to be agitated up and dispersed into the room, which is unhealthy. Also, the leakage reduces the exhaust flow guided to the rotating brush, thus reducing the ability to provide adequate rotation to the rotating brush, and thereby lowering cleaning efficiency.

One way to overcome these problems is to prevent leakage of exhaust air by using sealing means such as gaskets between the elements forming the exhaust path such as the cover. However, this requires installing the sealing means, which makes assembly less efficient. Also, dimensions of elements forming the exhaust path such as the cover may change over time, creating gaps in the exhaust path and resulting in leakage.

The object of the present invention is to overcome the problems described above and to provide an electric cleaning device that uses a simple structure to prevent circulating exhaust air from leaking outside the main case unit.

The first means of the present invention includes: a main cleaning device unit equipped with an electric blower; a flexible hose connected to the main cleaning device unit; an extension pipe selectively connected to the hose; a floor intake tool connected to the extension pipe; and a circulation path circulating exhaust from the electric blower to the floor intake tool. The exhaust guide is formed integrally as a cylinder. One end of the exhaust guide is connected to an opening formed on an electric blower holding chamber housing the electric blower. Another end of the exhaust guide is connected to a communicating opening continuous with the circulation path formed in the hose.

In the first means of the present invention it is desirable for the exhaust guide to be flexible, and for a connecting section formed on the exhaust guide to be fitted to the opening and the communicating opening.

The second means of the present invention includes: a main cleaning device unit equipped with an electric blower; a flexible hose connected to the main cleaning device unit; an extension pipe selectively connected to the hose; a floor intake tool connected to the extension pipe; and a circulation path circulating exhaust from the electric blower to the floor intake tool. A section of a motor case surrounding the electric blower and an exhaust guide connecting a circulation path formed in a hose and circulating exhaust air from the electric blower to the floor intake tool are formed integrally.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
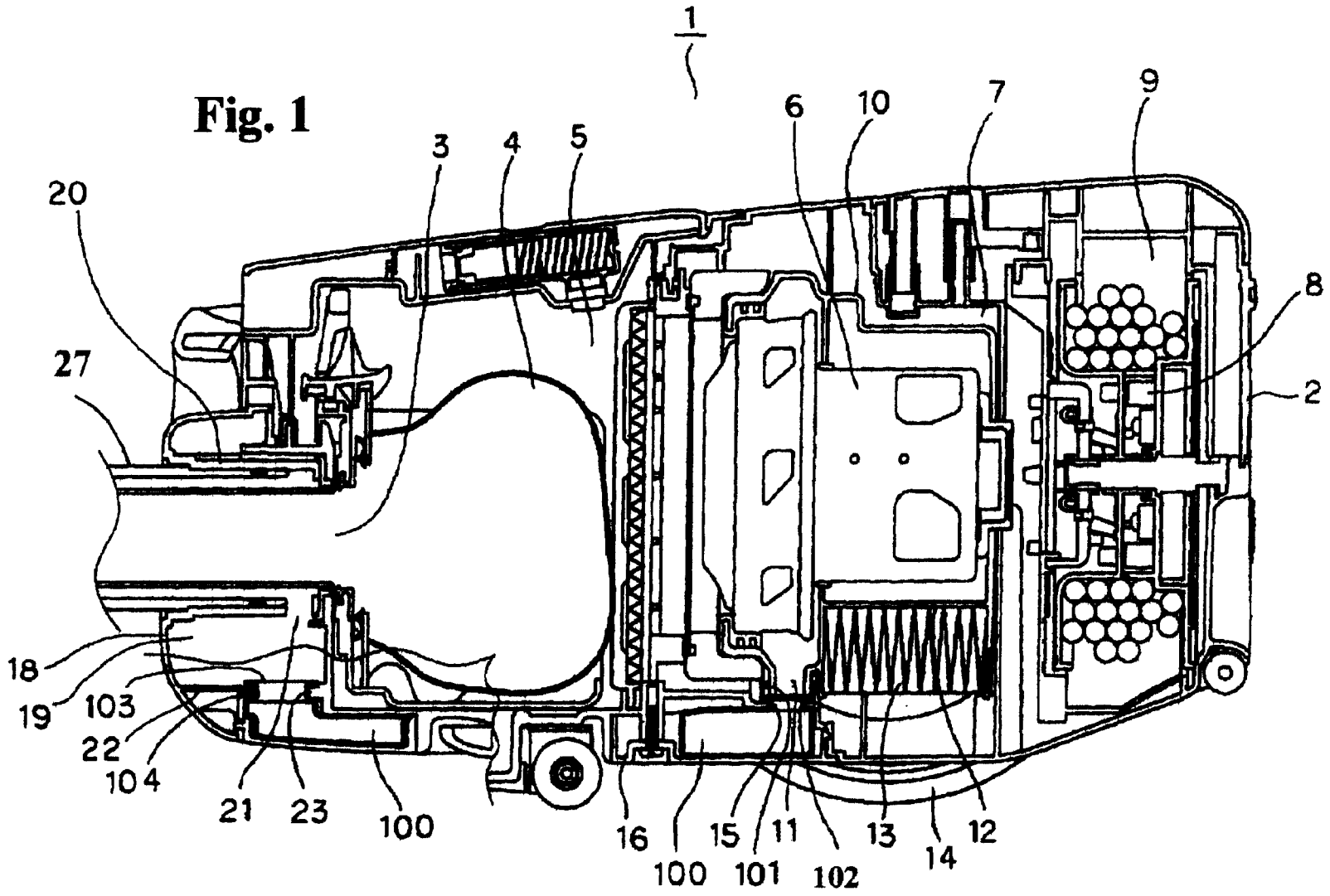
FIG. 1 is across-section drawing of a main cleaning device unit according to a first embodiment of the present invention.

Referring to FIG. 1, a main cleaning device unit 1 includes a main unit case 2 having a cover 16 (described later) attached to its outer bottom. A front cover 18 (described later) is attached to the front of the main unit case 2. An intake opening 3 is formed on the front wall of the main unit case 2. At the front, the main unit case 2, a dust collection chamber 5 that communicates with the intake opening 3. A removable paper pack 4 is placed in the dust collection chamber 5 to trap dust. In the middle position, an electric blower holding chamber 7 housing an electric blower 6. At the rear, a cord reel chamber 9 housing a cord reel 8.

The electric blower 6 is covered by a motor cover 10. The motor cover 10 has a first opening 11 radially aligned with the blower of the electric blower 6. A second opening 12 is radially aligned with the motor of the electric blower 6. A filter 13 is mounted in the second opening 12. A portion of the exhaust from the electric blower 6 passes the motor and exits the motor cover through the second opening 12 and the filter 13 along an axis sections of wheels 14 at the sides of the main unit case 2.

A return opening 15 in the bottom surface of the electric blower holding chamber 7 of the main unit case 2 is aligned with the first opening 11 of the motor cover 10 covering the electric blower 6.

Figure 2:
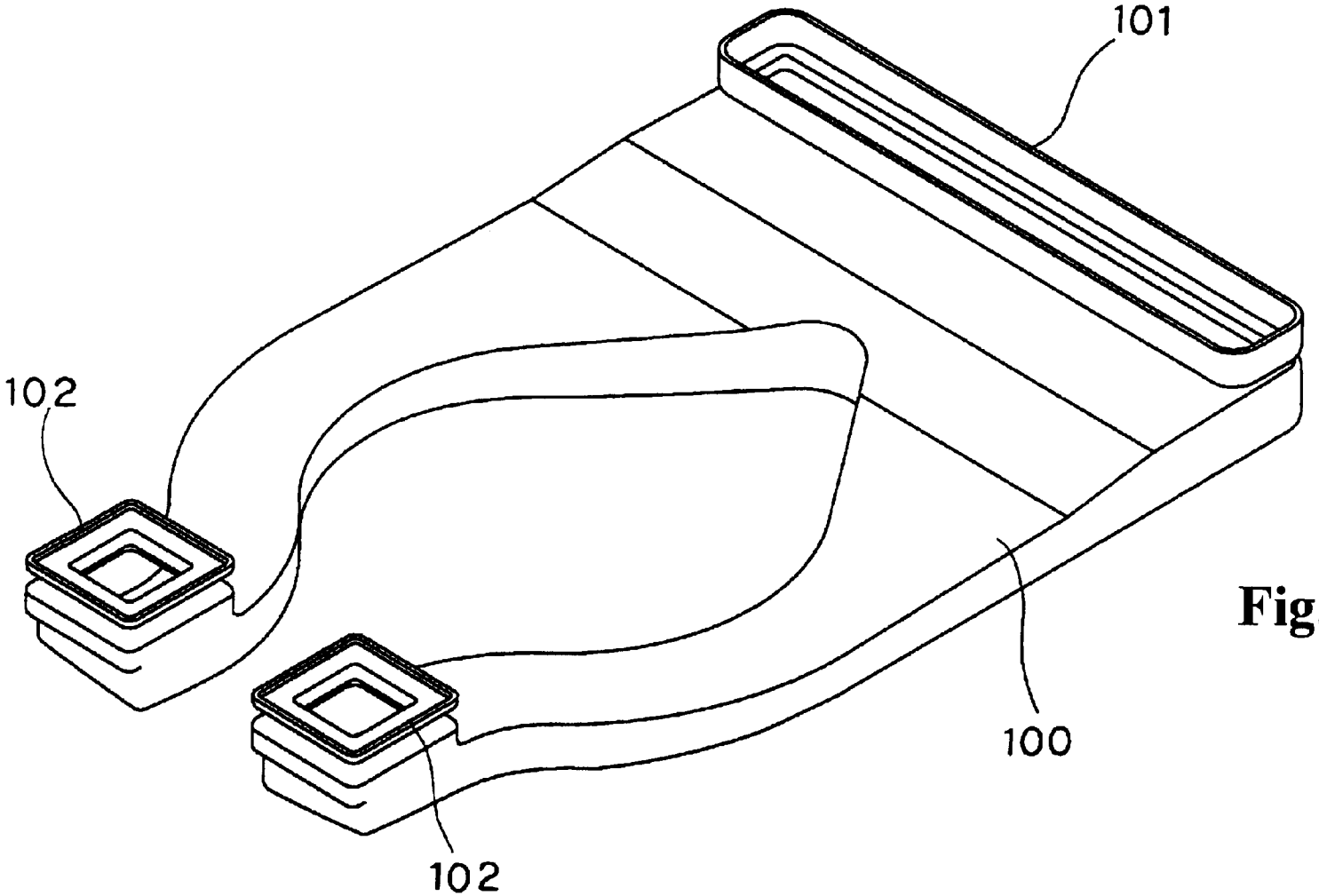
FIG. 2 is a perspective drawing of an exhaust guide.

Referring now to FIG. 2, a blow-molded exhaust guide 100 includes a first opening 101 at one of its ends. First opening 101 has dimensions exceeding the dimensions of the return opening 15. A plurality of second openings 102 (two in this embodiment) are formed at the other end of the exhaust guide 100. The dimensions of the second openings exceed the dimensions of the communicating openings 23, described later.

Returning now to FIG. 1, a first fitting section 103 is formed near the first opening 101 of the exhaust guide 100. The first fitting section 103 has dimensions that are smaller than the dimensions of the return opening 15. A pair of second fitting sections 104 are fitted near the second openings 102 of the exhaust guide 100. The dimensions of the second fitting sections 104 are smaller than the dimensions of the communicating openings 23, described later.

The first fitting section 103 is fitted into the return opening 15 and the second fitting sections 104 are fitted into the communicating openings 23. As a result, exhaust from the electric blower 6 goes through the return opening 15 by way of the exhaust guide 100 and passes through the communicating openings 23.

The exhaust guide 100 has flexible thin walls. This flexibility allows the first opening 101 and the second openings 102 to be deformed inwardly for easy insertion into the return opening 15 and the communicating openings 23, respectively. This permits the first fitting section 103 and the second fitting section 104 to be fitted into the return opening 15 and the communicating opening 23, thus improving assembly efficiency.

The inwardly deformed first opening 101 and the second opening 102 are urged outward by the resilient restorative force of the plastic material from which the exhaust guide 100 is blow molded. This prevents the exhaust guide 100 from disengaging from the return opening 15 and the communicating opening 23 while also improving sealing around the return opening 15 and the communicating opening 23. The cover 16 covers the exhaust guide 100. The cover is attached to the outer bottom surface of the main unit case 2 by any convenient means such as the screw shown.

The front cover 18 is attached spaced forward of the front of the main unit case 2. The space thus formed defines an exhaust space between the front cover and the main unit case 2. A hose connection cylinder 20 is generally centered in the front cover 18. A first connecting member 27 of a host 24, described later, is insertable into the hose connection cylinder 20. The opening of the hose connecting cylinder 20 is aligned with the intake opening 3 of the main unit case 2. A communicating opening 21 is formed integrally with the hose connecting cylinder 20. The communicating opening 21 interconnects the exhaust space 19 and the hose connecting cylinder 20.

A panel wall 22, on the lower portion of the front wall of the main unit case 2, extends toward the front of the main cleaning unit 1. A communicating opening 23, in the panel wall 22, provides a connection between the exhaust guide 100 and the exhaust space 19.

Figure 3:
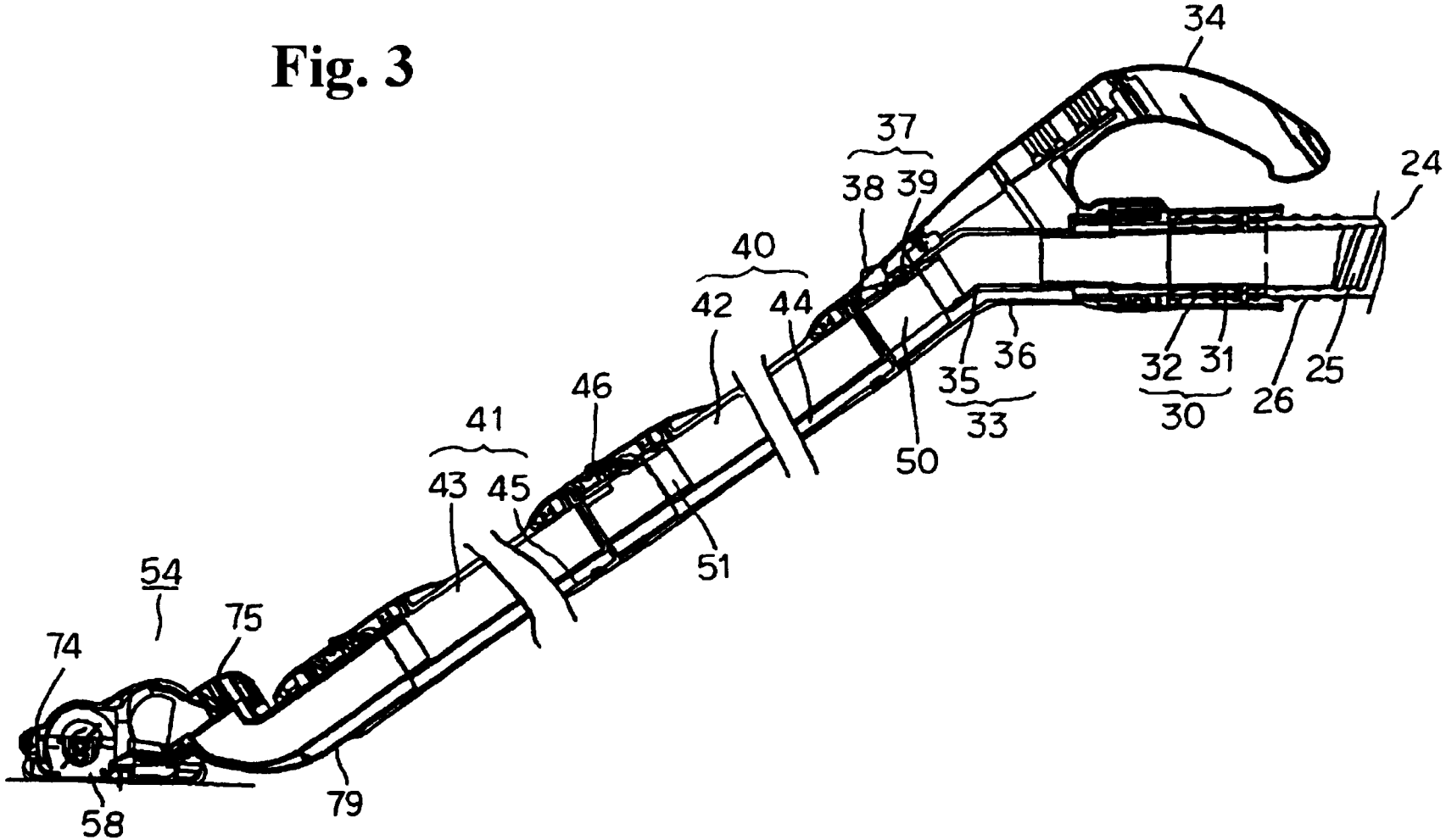
FIG. 3 is a cross-section drawing extending from a handle tube of a flexible hose to a floor intake tool.
Figure 4:
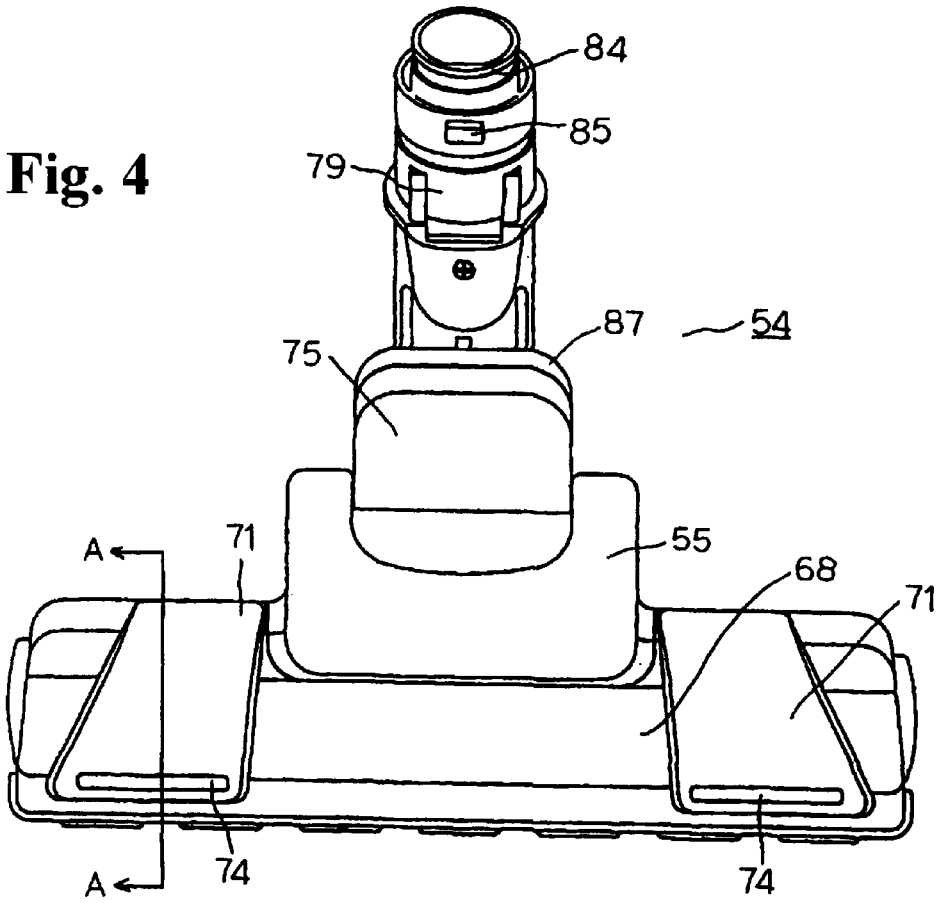
FIG. 4 is a top-view drawing of a floor intake tool.
Figure 5:
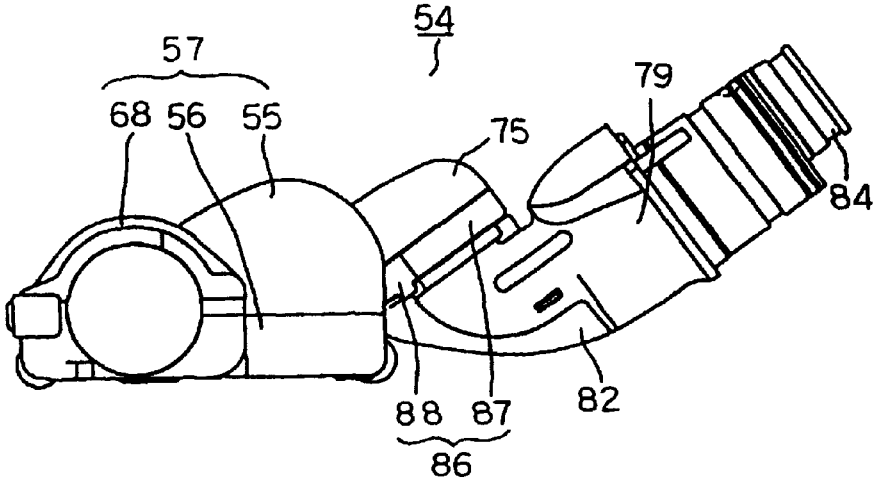
FIG. 5 is a side-view drawing of the floor intake tool.
Figure 6:
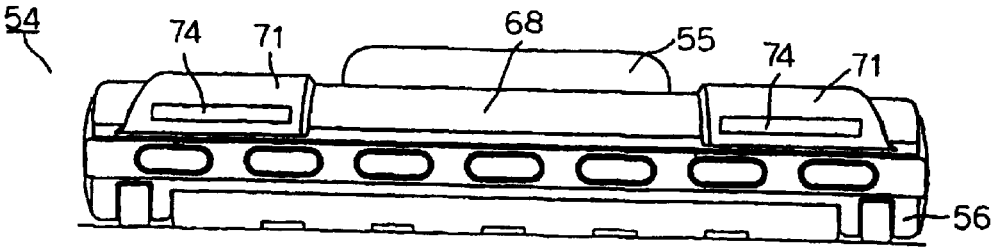
FIG. 6 is a front-view drawing of the floor intake tool.
Figure 7:
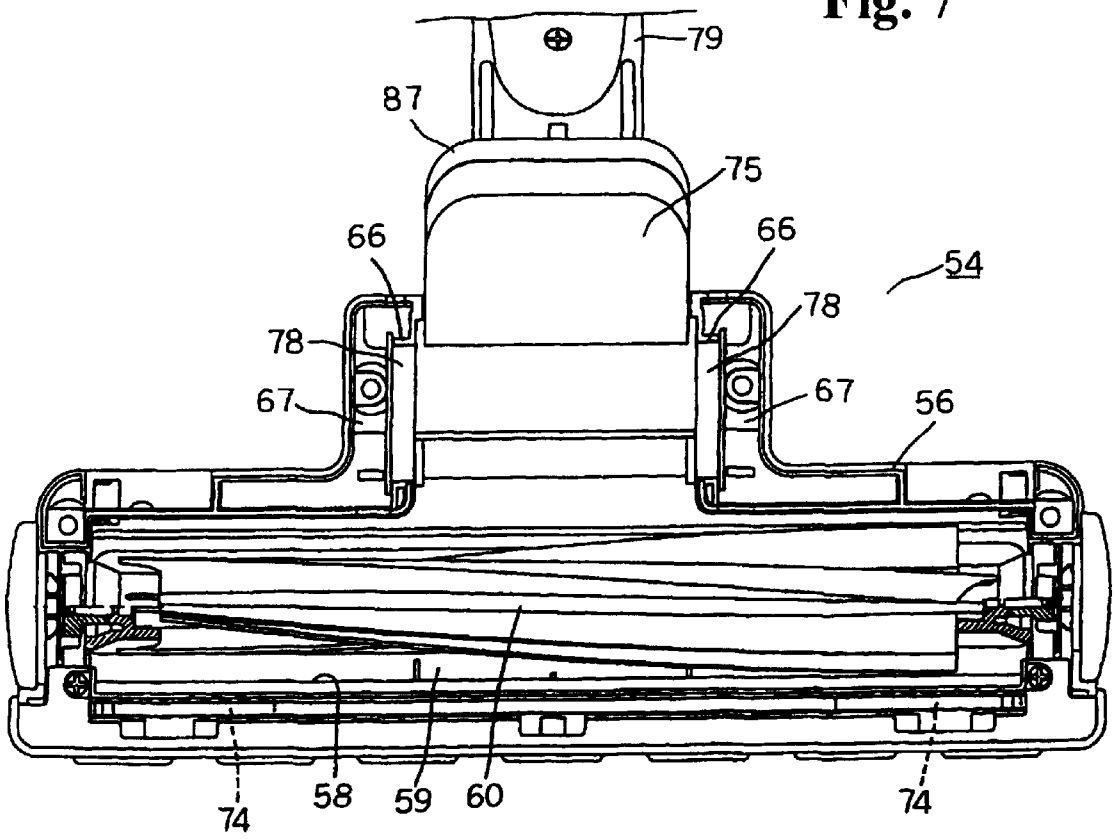
FIG. 7 is a top-view drawing of a floor intake tool with an upper case and cover removed.
Figure 8:
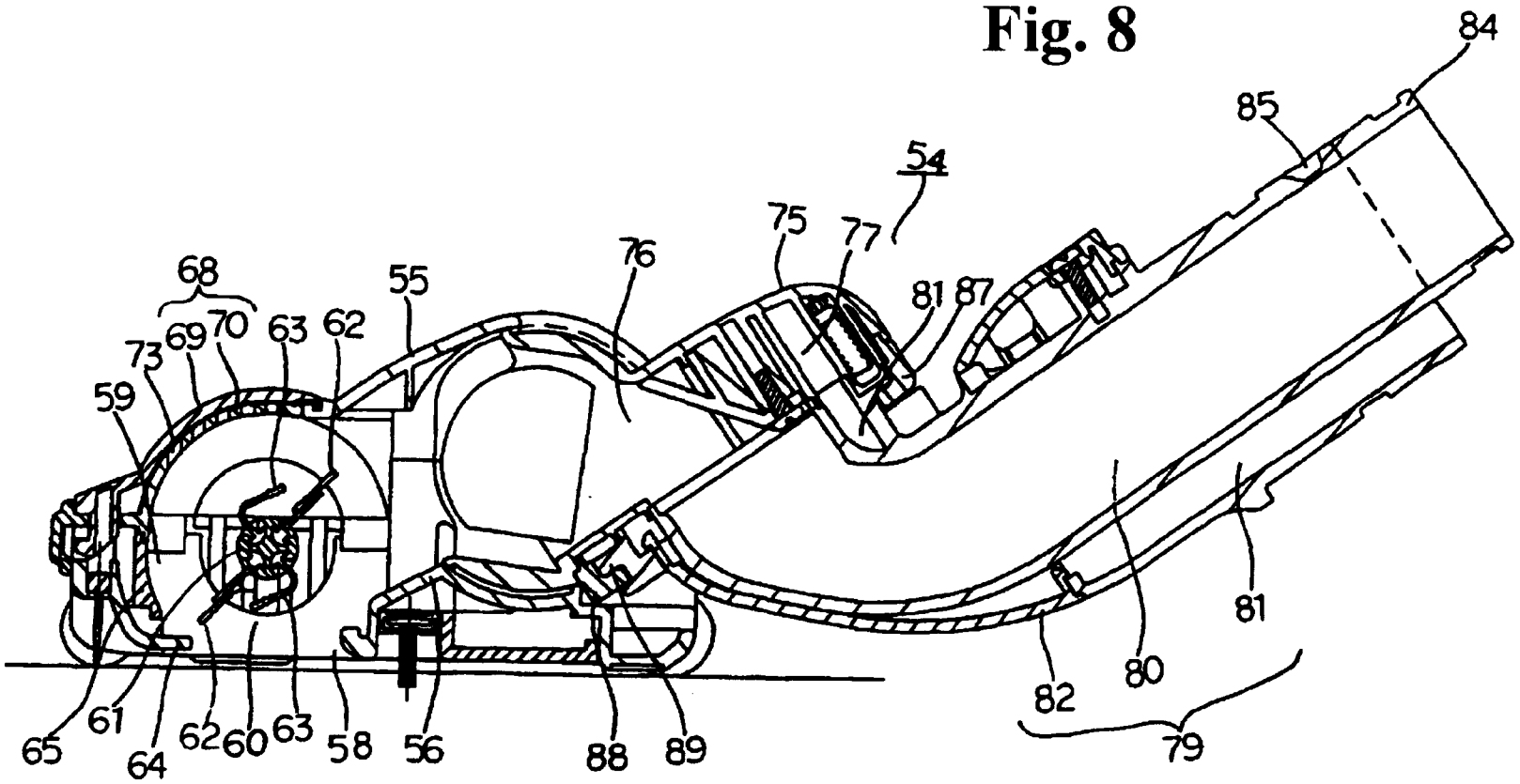
FIG. 8 is a cross-section drawing of a floor intake tool.
Figure 9:
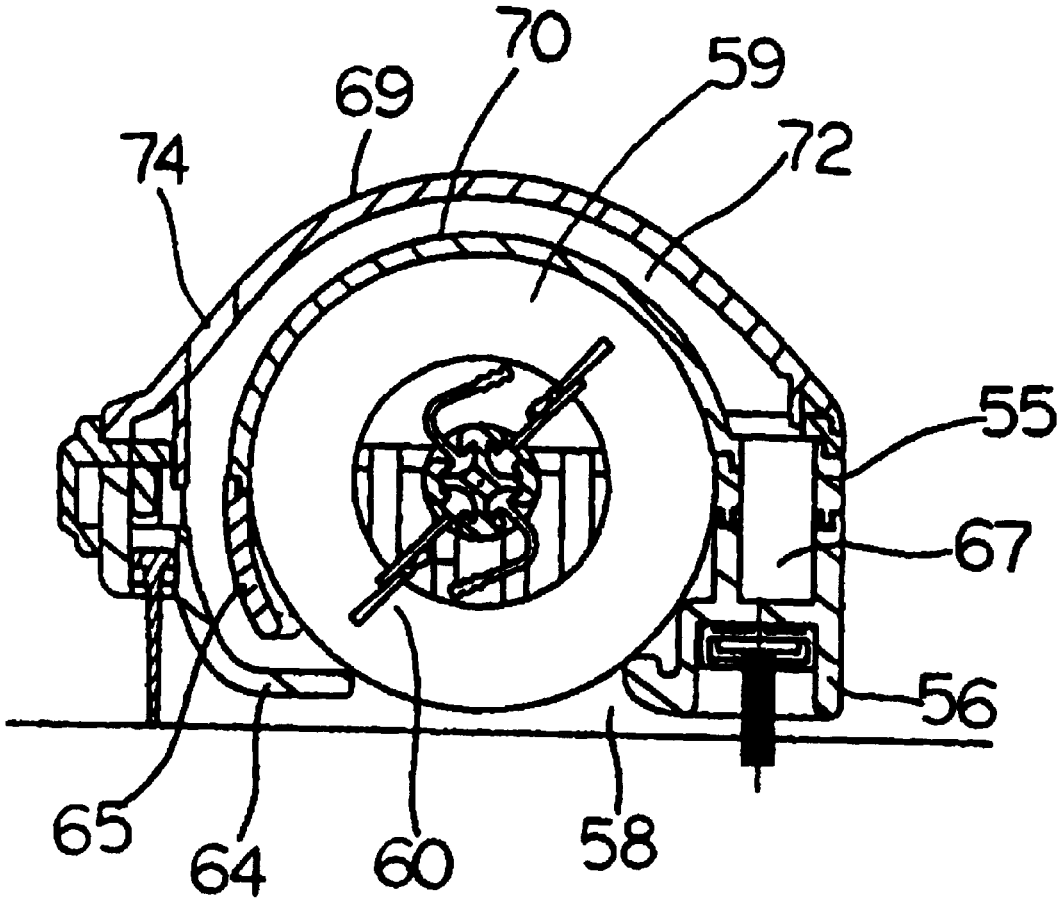
FIG. 9 is a cross-section drawing along the A—A line in FIG. 3.
Figure 10:
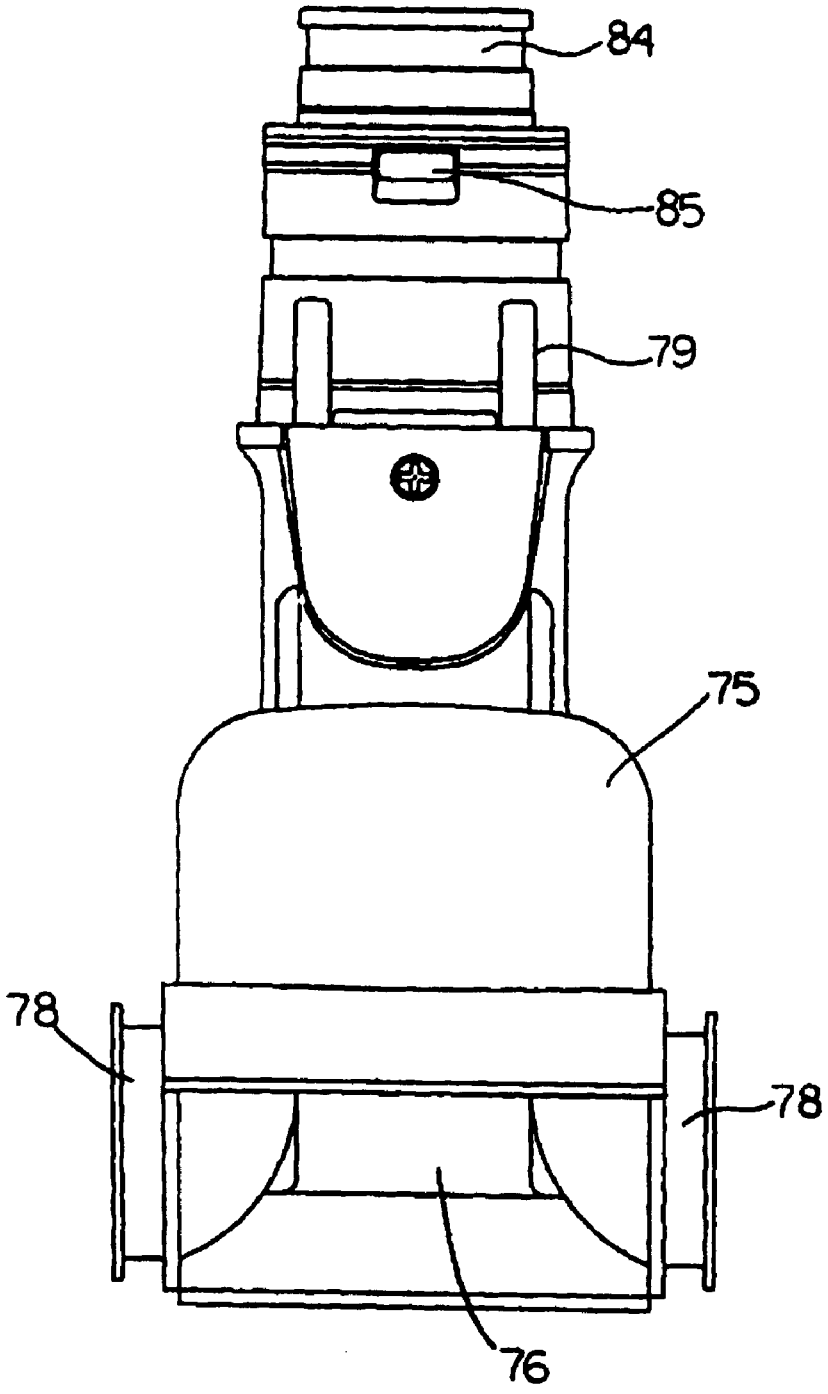
FIG. 10 is a front-view drawing of a pivoting tube and a connecting tube.
Figure 11:
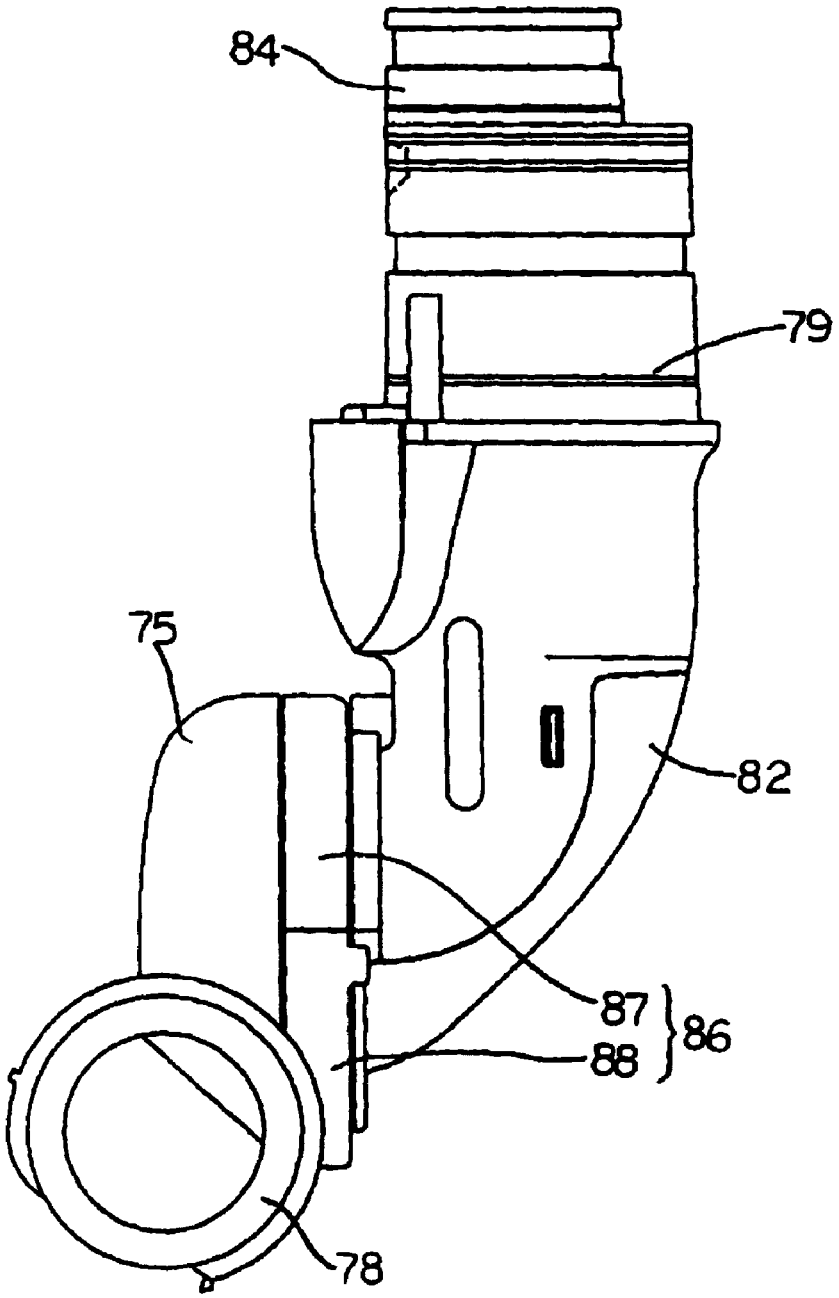
FIG. 11 is a side-view drawing of the pivoting tube and connecting tube.
Figure 12:
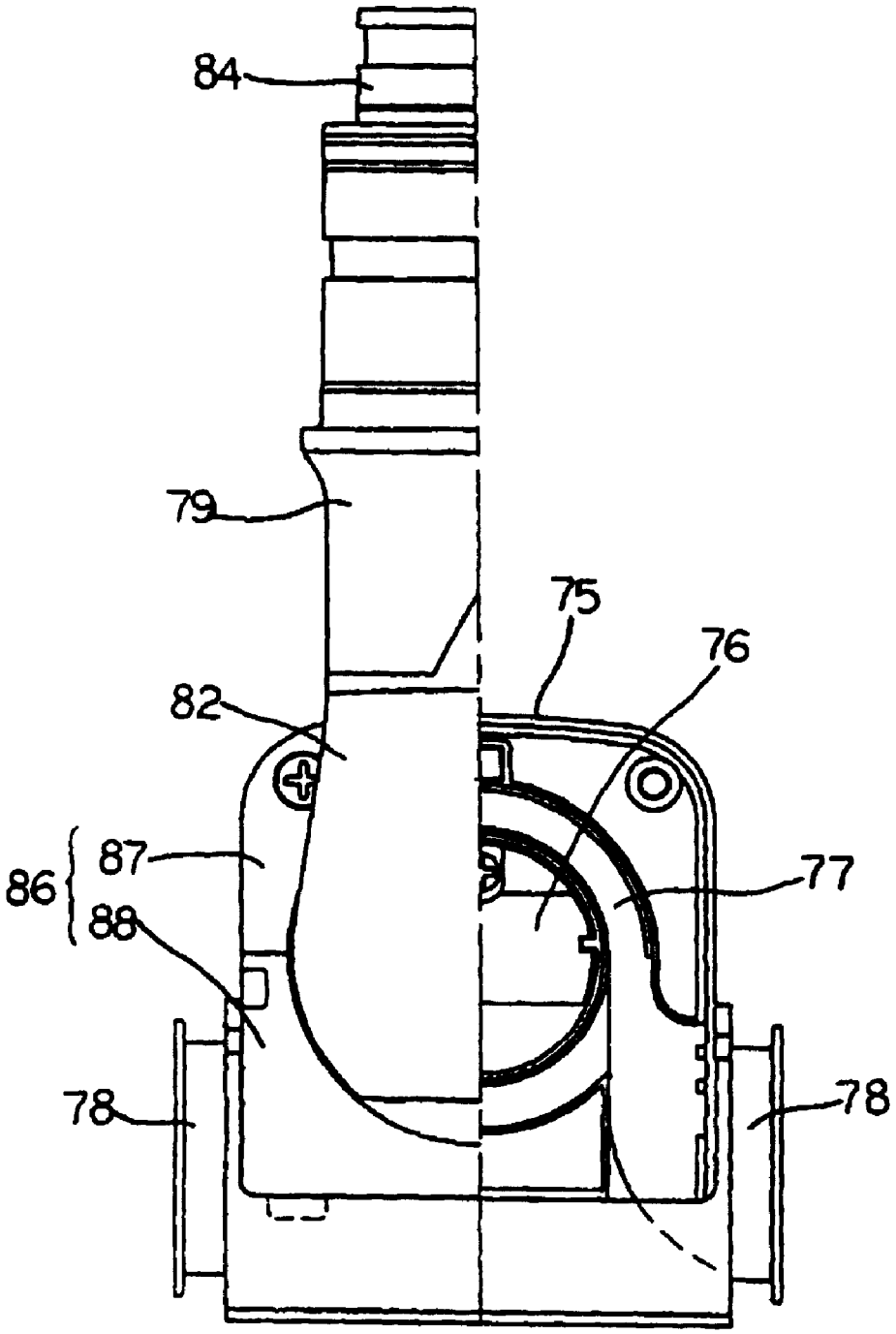
FIG. 12 is a rear-view drawing of a pivoting tube and a connecting tube connected, as well as a bottom-view drawing of the pivoting tube.
Figure 13:
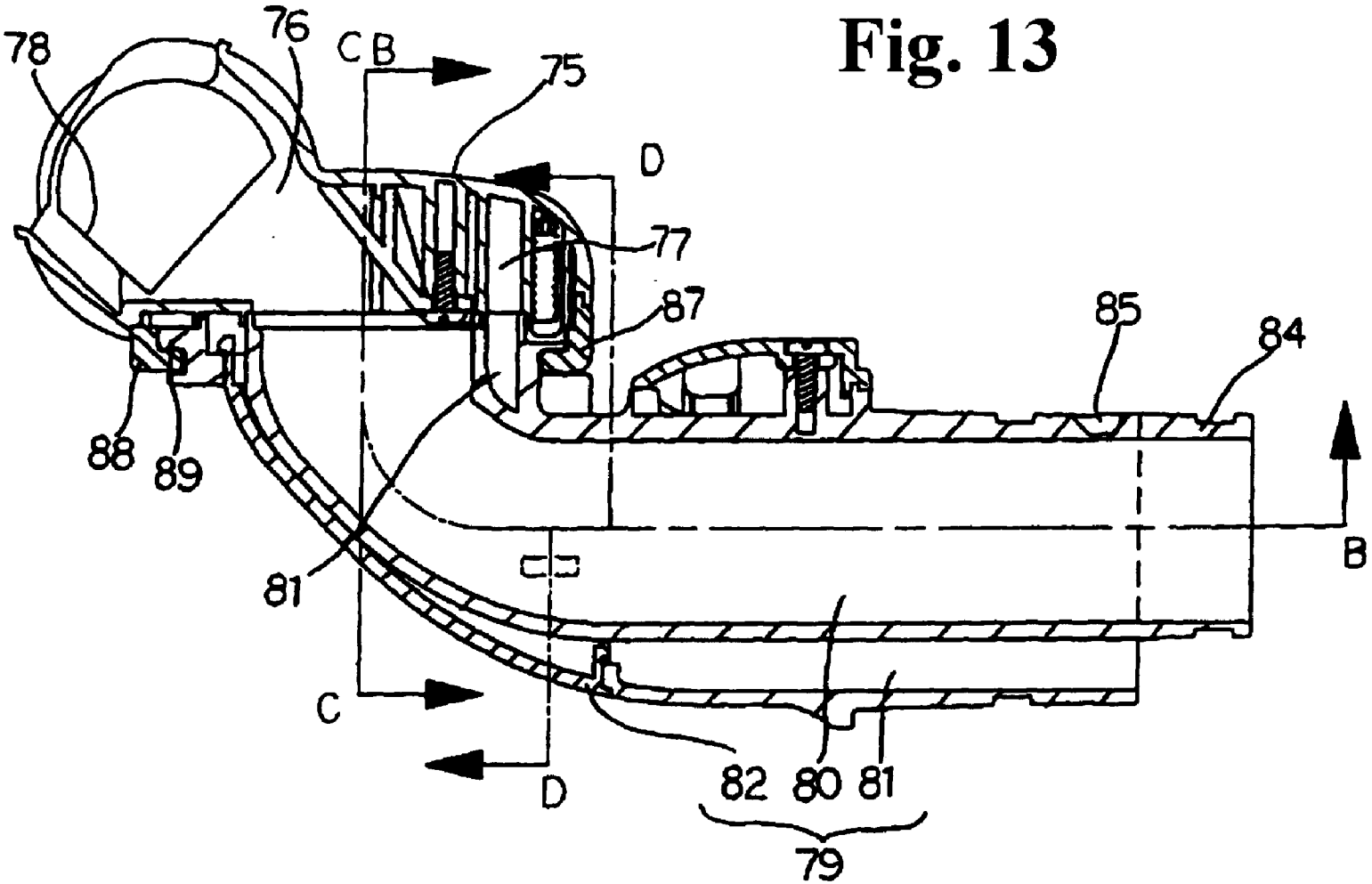
FIG. 13 is a cross-section drawing of a pivoting tube and a connecting tube.
Figure 14:
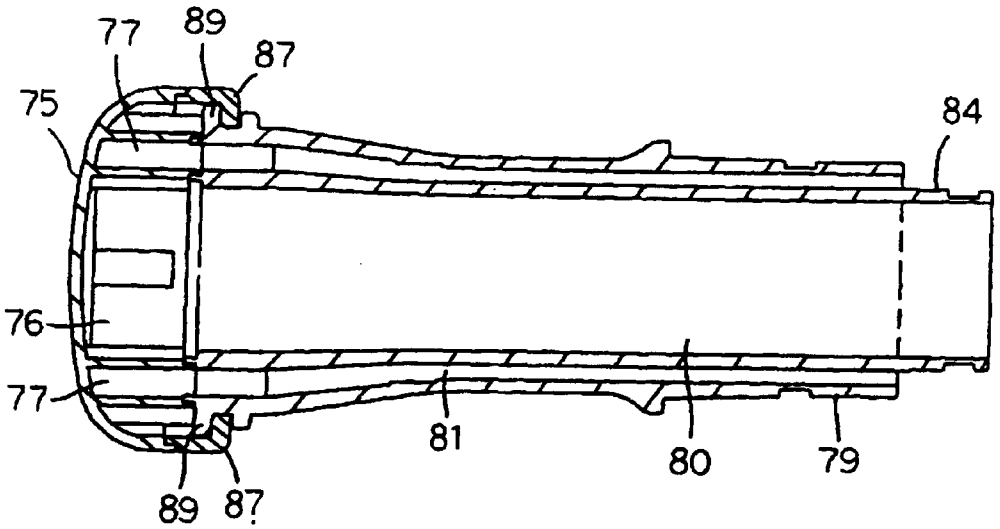
FIG. 14 is a cross-section drawing along the B—B line in FIG. 12.
Figure 15:
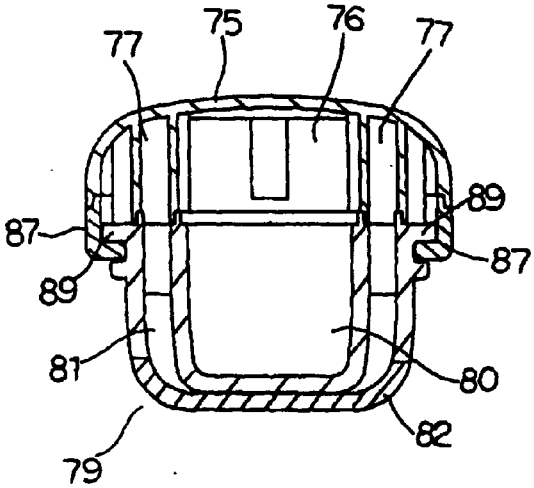
FIG. 15 is a cross-section drawing along the C—C line in FIG. 12.
Figure 16:
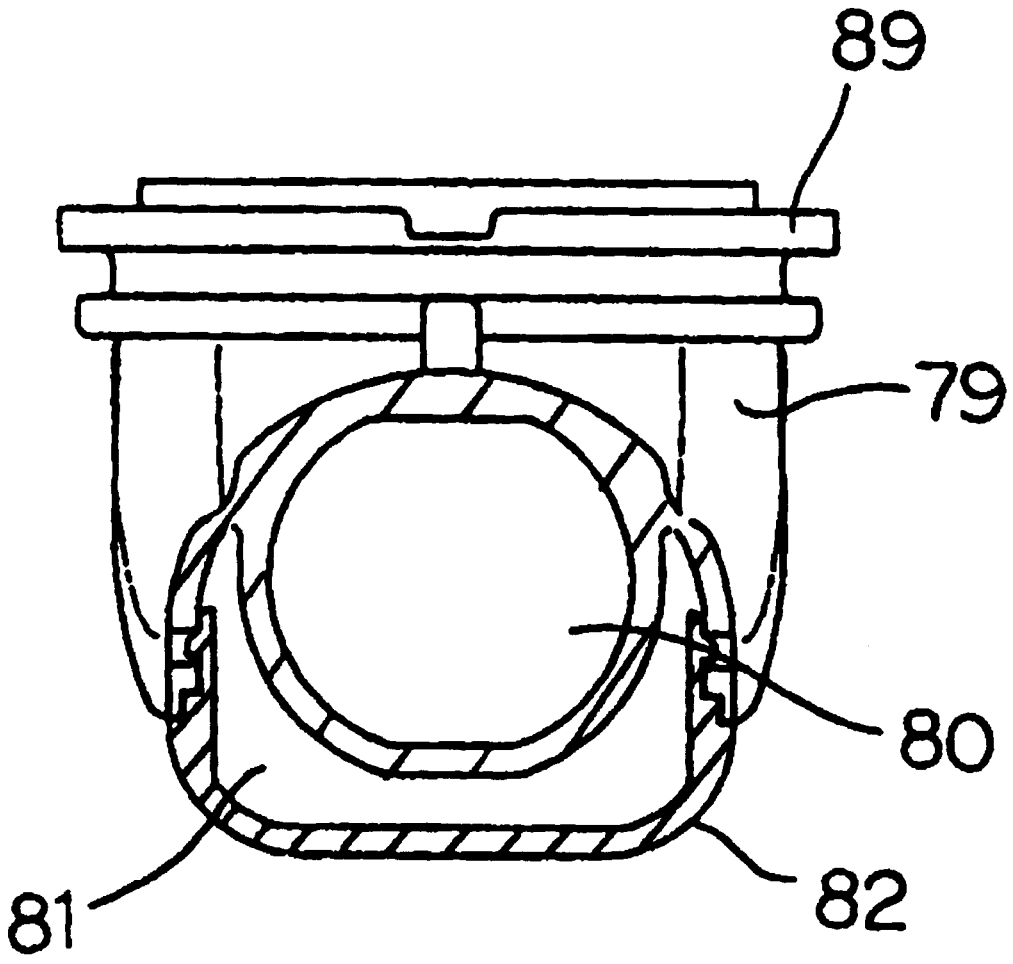
FIG. 16 is a cross-section drawing along the D—D line in FIG. 12 with a pivoting tube removed.
Figure 17:
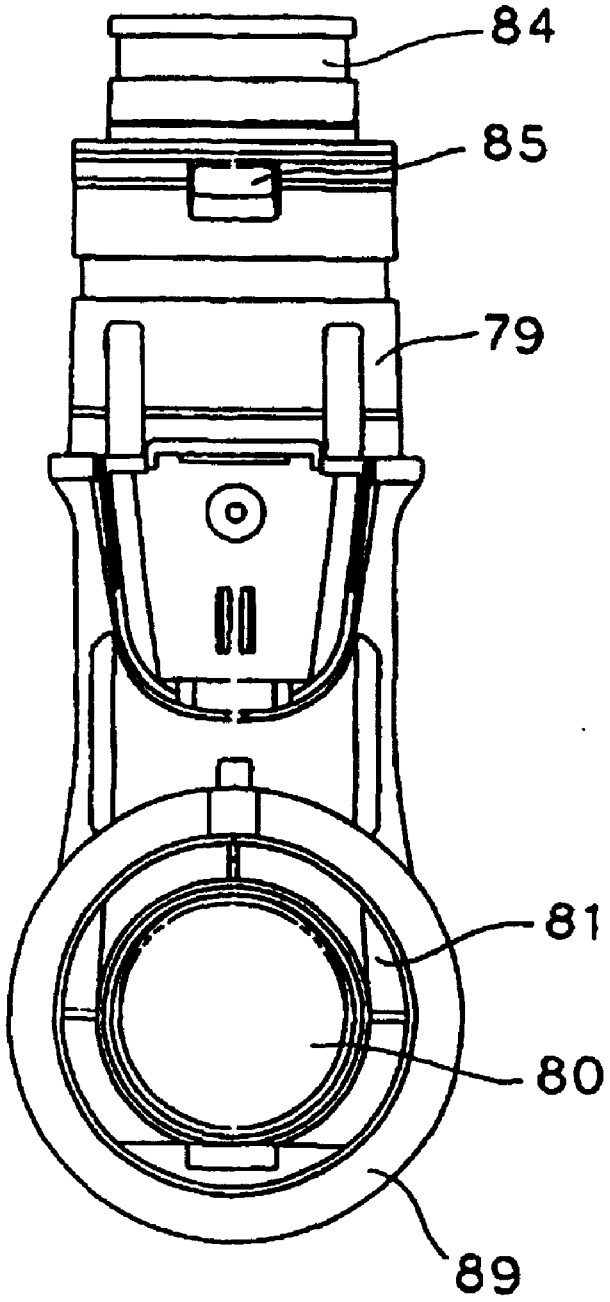
FIG. 17 is a top-view drawing of a connecting tube.
Figure 18:
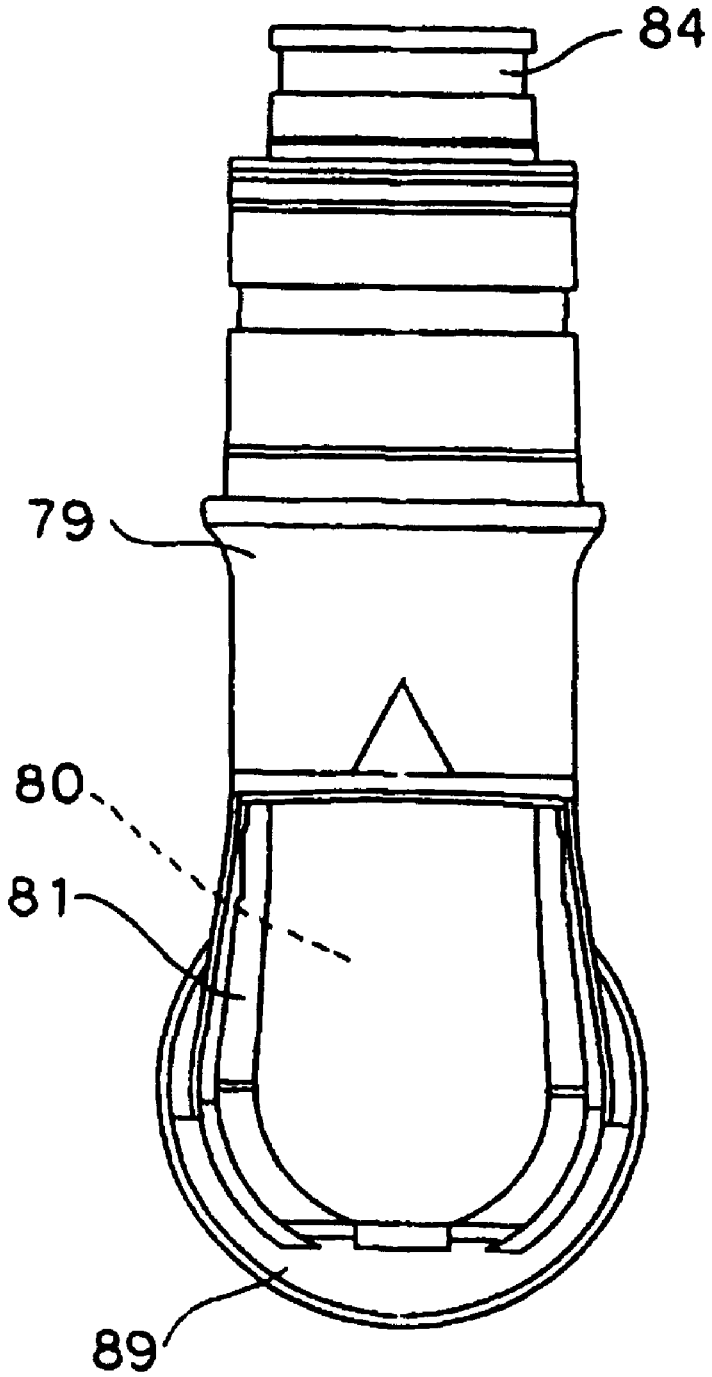
FIG. 18 is a bottom-view drawing of a connecting tube.

Referring now also to FIG. 3, a hose 24 is removably connected to the main cleaning device unit 1. The hose 24 is a two layer structure having a flexible inner hose 25 and a flexible outer hose 26. The diameter of the inner hose 25 is substantially smaller than the diameter of the outer hose 26, thus leaving a space therebetween. The inner hose 25 forms an intake path. The space between the inner hose 25 and the outer hose 26 is an exhaust path. The exhaust path is made continuous with the exhaust space 19 by the communicating opening 21. A conductive and shape-retaining coil is embedded in the outer hose 26.

The inner hose 25 does not contain a stiffener such as an embedded coil or the like. If the user accidentally steps on, or otherwise deforms the hose 24, the shape of the inner hose 25 is restored, since the outer hose 26 is returned to its full outline by the shape-retaining coil embedded therein. Thus, the inner hose 25 will not be deformed as long as the outer hose 26 is not deformed. When the inner hose remains undistorted, dust clogging of the inner hose 25 is prevented. If the outer hose 26 is deformed, this condition is visible to the user to indicate that the inner hose 25 is also crushed. The user is thus alerted to cure the problem of the distorted outer hose 26, thereby preventing dust from accumulating unnoticed in the inner hose 25.

The inner hose 25 is preferably formed of an opaque or colored resin and the outer hose 26 is preferably formed from a semi-transparent resin. The semi-transparent outer hose 26 permits the user to see the inner hose 25 as a further confirmation that the inner hose 25 remains undistorted.

A connecting member 30 is disposed on the outer end of the hose 24. The connecting member 30 includes an inner member 31 connected to the inner hose 25 and an outer member 32 connected to the outer hose 26.

A handle tube 33 is formed integrally with a grip 34. The connecting member 30 connected to the hose 24 is rotatably and electrically connected to the handle tube 33. The handle tube 33 is includes an inner cylinder 35 having a generally circular cross-section which serves as an intake path. The inner cylinder 35 is aligned with the inner member 31. An outer cylinder 36 covers the bottom of the inner cylinder 35 (opposite from the grip 34). A space between the inner cylinder 35 and the outer cylinder 36 serves as an exhaust path communicating with the outer member 32 of the second connecting member 30.

A clamp 37 is pivotably disposed inside the handle tube 33. A pressure-sensitive section 38, or spring-loaded push button, at one end of the claim is exposed at the upper surface of the handle tube 33. A hook 39, formed on the other end of the clamp 37, is projected and recessed in an opening (not shown in FIG. 3) in the inner tube 35. The hook 39 is disengaged from the opening by pressure applied by the user to the pressure-sensitive section 38 to permit disengagement of the handle tube 33.

A first extension pipes 40 is removably attached to the handle tube 33 by the clamp 37. First extension pipe 40 includes a cylindrical intake cylinder 42 and a crescent-shaped exhaust cylinder 44, having shapes matching the shapes of corresponding elements in the insertion cylinder 50 of handle tube 33.

A second extension pipe 41 is fitted to the outer end of the first extension pipe 40, and secured in place by a second clamp 46. An intake cylinder 43 and an exhaust cylinder 45 have shapes generally matching corresponding elements in first extension pipe 40.

Figure 19:
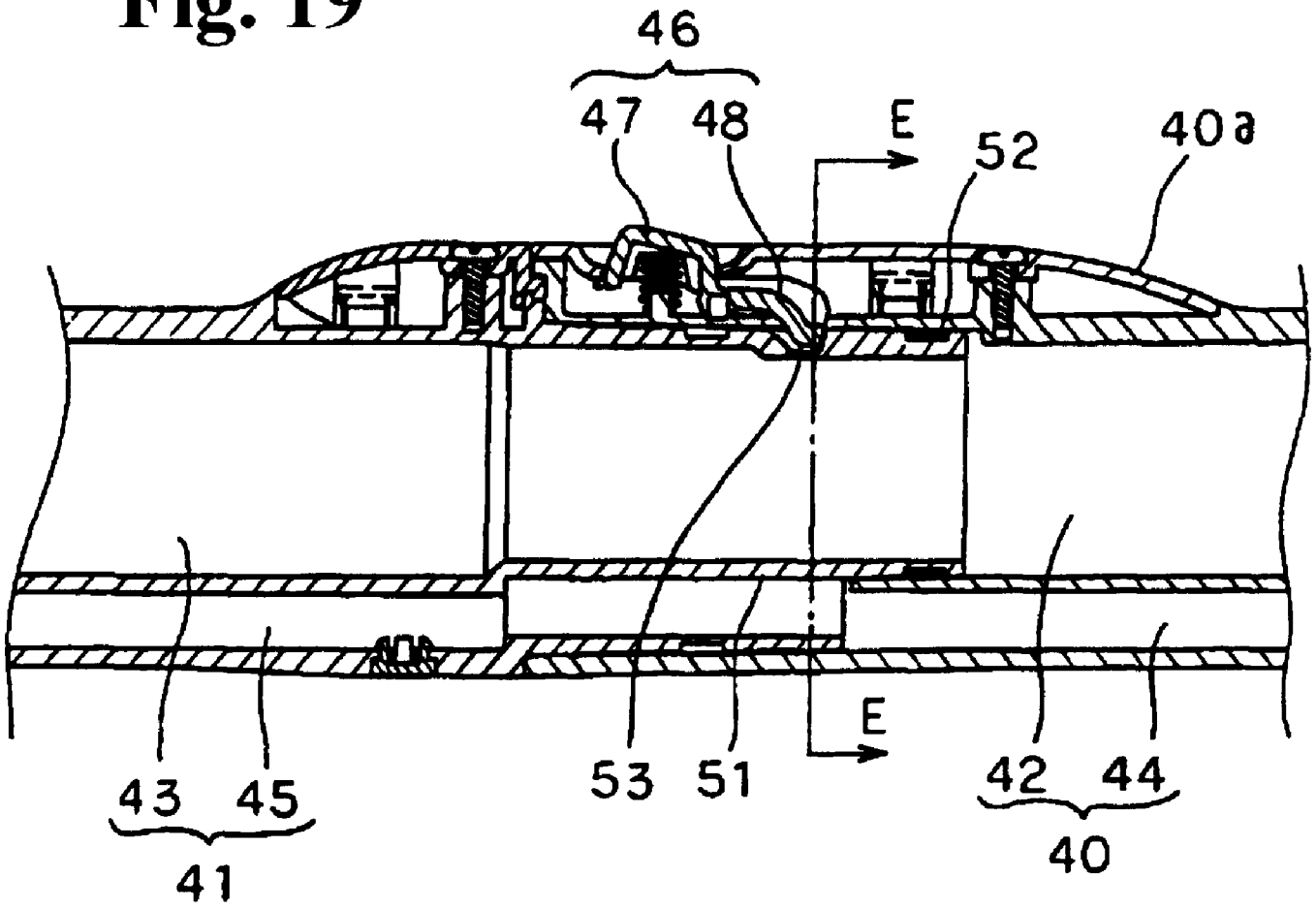
FIG. 19 is a cross-section drawing of a connecting section between a first extension pipe and a second extension pipe.
Figure 20:
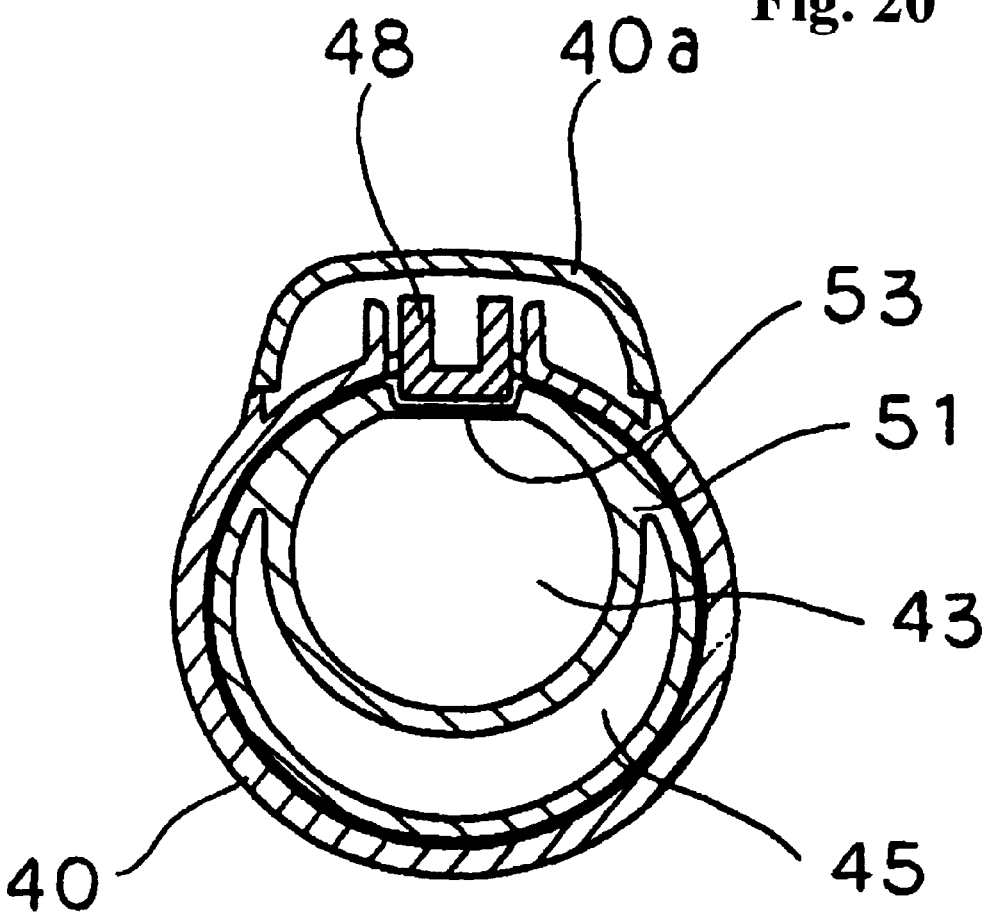
FIG. 20 is a cross-section drawing along the E—E line in FIG. 18.

Referring now to FIG. 19, clamp 46, similar to the clamp 37 of the handle tube 33, is disposed at the other end (the side connecting to the second extension pipe 41) of the first extension pipe 40. A cover 40*a* is integrally attached to the outer surface of the intake tube 40. The clamp 46 is disposed between the first extension pipe 40 and the cover 40*a*. The pressure-sensitive section 47, at one end of the clamp 46, is exposed for actuation by a user through the upper surface of the cover 40*a*. A hook 48, at the other end of the clamp 46, is normally spring loaded into locking contact in an engagement cavity 53 in an outer surface of the intake cylinder 43. When the hook 48 is in the engaged position shown, the first extension pipe 40 is locked to second extension pipe 41. Pressing on pressure-sensitive pressure-sensitive section 47 hinges the hook 48 out of the engagement cavity 53, whereby the extension pipes 40 and 41 may be disengaged.

Referring now also to FIG. 3, at inner ends of the first and second extension pipes 40, 41, insertion cylinders 50, 51 permit insertion thereinto of the outer ends of the handle tube 33 and the first extension pipes 41, respectively. A seal 52 is disposed on the outer perimeters of the insertion cylinders 50, 51 of the intake cylinders 42, 43.

The above description details the connecting section between the first extension pipe 40 and the second extension pipe 41. The connecting section between the second extension pipe 41 and a floor intake tool 54, described later, is formed similarly and the corresponding descriptions and figures are omitted.

Referring now to FIGS. 3–9, the floor intake tool 54 is removably connected to the outer end of the second extension pipe 41. A main suction tool unit 57 including an upper case 55, a lower case 56, and a cover 68. The cover 68 can be installed on, and removed from the upper and lower cases 55, 56. A pivotable tube 75 is supported by the upper and lower cases 55, 56. Pivotable tube 75 is free to pivot up and down relative to the main suction tool unit 57. A connecting tube 79 is rotatable about the perimeter of the pivotable pipe 75.

An intake opening 58 is formed on the bottom surface of the main intake tool unit 57. A rotating brush holding chamber 59 is formed in the main intake tool unit 57. Rotating brush holding chamber 59 contain a rotating brush 60 that extends to the intake opening 58.

The rotating brush 60 has core 61 to which are attached a pair of brushes 62. The bases of the brushes 62 are inserted into spiral-shaped grooves in the core 61. A pair of blades 63, similarly have their bases inserted into spiral-shaped grooves in the core 61. The blades 63 are preferably molded in an arcuate shape from nylon, polyethylene resin, or the like.

A guide section 64 is formed roughly horizontally at the front of the intake opening 58 of the lower case 56. A guide member 65 is disposed continuously with a lower member 70 of the cover 68. The guide member 65 is spaced a distance from the front wall of the lower case 56 and the guide section 64. The guide member 65 guides the exhaust from a path 72 toward the guide section 64.

The lower end of the guide member 65 is a discharge opening of the circulation path 72. The guide member 65 extends to the guide section 64, close to the surface to be cleaned. The exhaust from the circulation path 72 is discharged from a position close to the surface to be cleaned. This facilitates the drawing in of dust from the surface to be cleaned, thus improving cleaning efficiency.

The exhaust is deflected and guided by the guide section 64 toward the rotating brush 60. When cleaning carpets and the like, this prevents the blade 63 and the brush 62 of the rotating brush 60 from getting caught in the carpet and having their rotation force reduced.

Bearings 66 are formed at each side of a center-rear section of the upper and lower cases 55, 56. A hollow shaft 78 of the pivotable tube 75 is pivotably supported by the bearings 66. Exhaust spaces 67 are formed continuously with the bearings 66 to guide exhaust from the electric blower 6 to the hollow shaft 78 of the pivotable tube 75.

The cover 68, removably attached to the upper and lower cases 55, 56, forms a ceiling for the rotating brush holding chamber 59. The cover 68 is formed by an upper member 69 and the lower member 70. A pair of projections 71 project upward extend across the entire front-to-back short axis of the upper member 69. The projections 71 are positioned toward the side-to-side ends of the long axis of the upper member 69, at positions over the ends of the rotating brush 60. Between the projections 71 and the lower member 70, paths 72 are formed for the exhaust from the exhaust space 67. The openings of the paths 72 toward the front forms the discharge opening for the exhaust.

The sections of the lower member 70 corresponding to the paths 72,72 are formed with a plurality of small holes 73 that reduce noise from the air flow in the rotating brush holding chamber 59.

Guide openings 74 are formed at the front of the projections 71 at positions corresponding to the ends of the rotating brush 60. The guide openings are continuous with the paths 72. Outside air, brought in from the guide openings 74, along with exhaust from the paths 72, are guided by the guide section 64 to the rotating brush 60 to rotate the rotating brush 60.

Referring now to FIGS. 10–13, the pivotable tube 75 is pivotable up and down relative to the main suction tool unit 57. The pivotable tube 75 includes an intake tube 76 extending from a connection to a connecting tube 79. The other end of the pivotable tube 75is supported by the main intake tool unit 57. An exhaust path 77, aligned with an exhaust path 81 of the connecting tube 79, is formed at the outer perimeter of the intake tube 76 at one end of the pivotable tube 75.

The hollow shaft 78, toward the other end of the pivotable tube 75, is continuous with the exhaust path 77. The hollow shaft 78 is pivotably supported by the bearings 66, 66 of the upper and lower cases 55, 56 to connect the exhaust path 77 of the pivotable tube 75 with the exhaust space of the main suction tool unit 57.

The connecting tube 79, connected to the pivotable tube 75, is pivotable about the perimeter of the pivotable tube 75. The connecting tube 79 is formed from: an intake path 80 continuous with the intake tube 76 of the pivotable tube 75; an exhaust path 81 formed integrally with the outer perimeter of the intake path 80 and continuous with the exhaust cylinder 45 of the second extension pipe 41; and a cover member 82 forming a section of the discharge path 81.

At the end toward the second extension pipe 41, the exhaust path 81 of the connecting tube 79 if formed with a crescent-shaped cross-section matching the shape of the exhaust cylinder 45 of the second extension pipe 41. Toward the end connected to the pivotable tube 75 of the connecting tube 79, the exhaust path 81 is formed so that it extends about the entire outer perimeter of the intake pipe 76.

An insertion cylinder 84 is formed on the connecting tube 79 toward the second extension pipe 41. Insertion cylinder 84 is similar to the end of the second extension pipe 41 toward the first extension pipe 40 and the first extension pipe 40 toward the handle tube 33. The insertion cylinder 84 includes with an engagement cavity 85 that is engaged in a manner the same as the hook 48 of the clamp 46.

A support cover 86 is attached to the lower end of the pivotable tube 75. The support cover 86 is formed from upper and lower support members 87, 88. Together with the end of the pivotable tube 75, the support cover 86 supports a collar 89 located at the edge of the opening of the exhaust path 81 of the connecting tube 79. This allows the pivotable tube 75 and the connecting tube 79 to pivot with respect to each other.

The pivotable tube 75 can be pivoted to a position roughly perpendicular to the main suction tool unit 57. The connecting tube 79 can be pivoted to the left and to the right of the pivotable tube 75 to positions roughly parallel to the floor surface. By pivoting the pivotable tube 75 to the perpendicular position and pivoting the connecting tube 70 to a horizontal position to either the left or the right, the first and second extension pipes 40, 41 are positioned roughly parallel to the main suction tool unit 57, thus allowing the main suction tool unit 57 to pass beneath furniture and the like for cleaning.

When the electric blower 6 is activated, air containing dust is sucked in to the intake opening 58 and the guide opening 74 of the floor intake tool 54. The air flows through the intake tube 76 of the pivotable tube 75, the intake path 80 of the connecting tube 79, the intake cylinders 42, 43 of the first and second extension pipes 40, 41, the inner cylinder 35 of the handle tube 33, the inner member 31 and the inner hose 25 of the second connecting member 30, an inner member of the first connecting member 27, and into the dust collection chamber 5.

The dust contained in the intake air is filtered in the paper pack 4. Most of the intake air is circulated as exhaust air to the exhaust guide 100 by way of the first opening 11 of the motor cover 10 and the return opening 15 at the bottom surface of the electric blower holding chamber. A portion of the intake air flows from the motor of the electric blower 6 to the second opening 12 of the motor cover 10 and discharged through the filter 13 along the axes of the wheels 14.

The exhaust air circulated through the exhaust guide 100 flows into the communicating opening 23 formed on the panel wall 22 of the main unit case 2. Since the exhaust guide 100 is an integral unit, the circulated exhaust air is prevented from leaking from the cleaning device main unit 1 due to exhaust pressure. Thus, the unhealthy stirring up of dust from the floor surface or carpet into the room due to leaked air is prevented.

The exhaust air flowing into the communicating opening 23 passes through the exhaust space 19 between the main unit case 2 and the front cover 18, the communicating opening 21 formed on the hose connecting cylinder 20 of the front cover 18, and the exhaust path formed between the inner hose 25 and the outer hose 26. The exhaust air then flows between the inner member 31 and the outer member 32 of the connecting member 30 and into the outer cylinder 36 of the handle tube 33. The exhaust air then flows through the exhaust cylinders 44, 45 of the first and second extension pipes 40, 41 and into the exhaust path 81 of the connecting tube 70 of the floor intake tool 54.

The exhaust air flowing into the exhaust path 81 of the connecting pipe 79 flows from the exhaust path 77 of the pivotable tube 75 to the exhaust space 67 of the main intake tool 57 by way of the hollow shaft 78. The exhaust air then flows through the path 72 formed in the projection 71 of the cover 68 and hits the guide 64, where it is blown to the rotating brush 60, thus rotating the rotating brush 60.

Since outside air is also flowing in from the guide opening 74 of the main intake tool unit 57, air flow is increased by the addition of the circulating exhaust from the path 72, thus improving the rotation of the rotating brush 60. Also, since the guide member 65 is disposed close to the guide 64 and continuous with the lower member 70 of the cover 68 forming the path 72, the exhaust air is prevented from being dispersed into the rotating brush holding chamber 59, thus guiding the air reliably to the rotating brush 60 and making the rotation of the rotating brush 60 more efficient.

The clamps 46, disposed at the connections between the handle tube 33 and the first extension pipe 40, the first extension pipe 40 and the second extension pipe 41, and the second extension pipe 41 and the connecting section of the connecting tube 79 of the floor intake tool 54, are all disposed in the intake path from the floor intake tool 54 to the main cleaning device unit 1. Thus, openings to the pressure-sensitive sections of the clamps 46 do not leak air to the outside, thus preventing unpleasantness to the user.

Taking the connection between the first extension pipe 40 and the second extension pipe 41 as an example, if the pressure-sensitive section 47 of the clamp 46 were to be disposed toward the exhaust cylinder 44, exhaust air flowing through the exhaust cylinder 44 could escape from the first extension pipe 40 through the opening 49 through which the hook 48 of the clamp 46 projects. This would result in unpleasantness to the user. However, in this embodiment, the clamp 46 is disposed on the intake cylinder 42, which is part of the intake path from the floor intake tool 54 to the main cleaning device 1. The intake flow of air sucked into the electric blower 6 through the intake cylinder 42 causes outside air to be drawn into the intake cylinder 42 by way of the opening 49 into which the hook 48 of the clamp 46 is projected. This prevents air from leaking out of the first extension pipe 40 and prevents unpleasantness for the user.

With the configuration described above, the exhaust from the electric blower 6 is circulated into the floor intake tool 54, thus reducing exhaust from the cleaning device. Also, this exhaust is provide additional rotational torque for the rotating brush 60, thus providing a healthy electric cleaning device with good cleaning efficiency.

Since the exhaust circulated from the electric blower 6 to the floor intake tool 54 is guided and deflected by the guide section 64 of the main intake tool unit 57 toward the rotating brush 60, exhaust air is not blown toward the floor surface. Thus, if the floor intake tool 54 is raised from the floor, the exhaust air does not disperse the dust on the surface being cleaned.

Furthermore, the flow of outside air, along with the circulated exhaust, into the guide opening 74 provides adequate rotation for the rotating brush 60, thus improving cleaning efficiency.

The path 72 and the guide opening 74 of the cover 68 are formed over the ends of the rotating brush 60. Thus, exhaust air circulating through the path 72 and the outside air from the guide opening 74 are blown primarily at the ends of the rotating brush 60 by way of the guide section 64.

The suction strength of the cleaning device corresponds to the suction strength at the intake tube 76 of the pivotable tube 75 connected at the rear-center of the main suction tool unit 57. The suction strength is strongest at the center of the suction opening 58. However, in the embodiment as described above, the exhaust is blown at the ends of the rotating brush 60. Thus, removal of dust at the ends of the rotating brush 60, where the suction force is weaker compared to the center of the suction opening 58, is enhanced.

If the guide openings 74 and the path 72 were extended across the entire width of the rotating brush 60, the air flow of the outside air drawn in from the guide openings 74 and the air flow of the exhaust from the path 72 would be reduced, thus preventing efficient rotation of the rotating brush 60. However, in this embodiment, the guide openings 74 and the path 72 are located near the ends of the rotating brush 60. Thus, the outside air is guided to the rotating brush 60 without a reduction in air flow. This improves rotation efficiency and improves cleaning efficiency.

The discharge opening of the path 72 is located at the front of the floor intake tool 54 (i.e., to the front of the rotating brush holding chamber 59). Thus, exhaust flowing from the rear of the floor intake tool 54 to the front is smoothly guided from the front of the rotating brush holding chamber 59, passing under, and then flowing toward the rear. Thus, the air flow is prevented from dropping, and suction is improved.

Furthermore, the guide opening 74 is formed continuously with the path 72 at the front of the floor intake tool 54. Thus, the air flow and suction is improved.

The guide member 65 is disposed at the discharge opening of the path 72 and the exhaust discharge opening from the path 72 is close to the surface being cleaned. Thus, the exhaust from the path 72 blows at the guide section 64. This prevents a drop in air flow and provides reliable rotation torque for the rotating brush 60, while also allowing dust on the surface to be cleaned to be efficiently drawn in.

Figure 21:
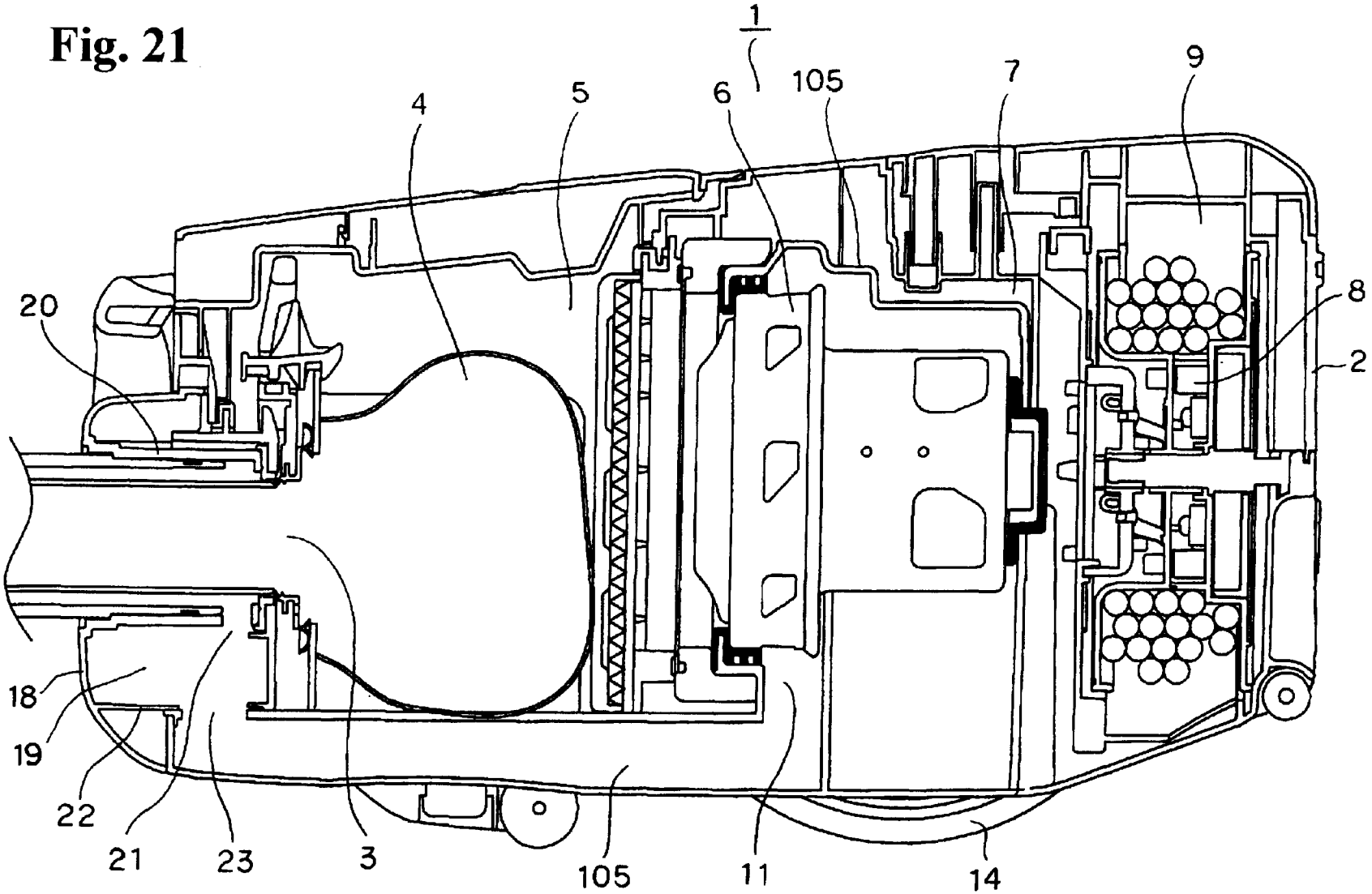
FIG. 21 is a cross-section drawing of a main cleaning device unit according to a second embodiment of the present invention.

Referring to FIG. 21, a second embodiment differs from the embodiment of FIG. 1 in that it positions its first opening 11 at a position corresponding to that of the return opening 15 of the motor cover 10 covering the electric blower 6. The first opening is connected to the integrally formed exhaust guide 105. This reliably prevents circulating exhaust from leaking out of the main cleaning device unit 1. In this embodiment, the motor cover 10 and the exhaust guide 100 of FIG. 1 are formed integrally as an exhaust guide 105, and the cover 16 is eliminated.

With this configuration, the circulating exhaust is reliably prevented from leaking out of the main cleaning device unit 1. Also, the simplified structure allows more efficient assembly.

According to the invention, an exhaust guide is formed integrally. One end of the exhaust guide is connected to an opening in an electric blower holding chamber that houses an electric blower. The other end of the exhaust guide is connected to a communicating opening on a main cleaning device unit. The exhaust guide is continuous with a circulation path formed in a hose. This reliably prevents circulating exhaust from escaping from the main cleaning device unit and prevents unhealthy dispersal of dust from a floor surface or carpet due to leaked air.

According to another embodiment of the invention, an exhaust guide is formed as a flexible guide, thus allowing the exhaust guide to be mounted efficiently and also improving the sealing properties of the connecting sections of the exhaust guide.

According to a further embodiment of the invention, a section of the motor case surrounding an electric blower and an exhaust guide connected to a communicating opening continuous with a circulation path formed in a hose are formed integrally. This simplifies the structure and provides more efficient assembly. Also, leakage of circulating exhaust from the main cleaning device unit can be reliably prevented and unhealthy dispersal of dust from a floor surface or carpet due to leaked air is prevented.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A vacuum cleaner comprising:

a blower unit;

a floor intake tool;

a suction path from said blower unit to said floor intake tool to suction air from said floor intake tool to said blower unit;

an exhaust path from said blower unit to said floor intake tool;

said exhaust path including an exhaust portion from said blower unit;

an integral exhaust guide connected at one end to said blower unit to receive exhaust air from said blower unit;

a second end of said exhaust guide connected to said exhaust path;

said exhaust guide has a single first opening connected to said exhaust portion; and said exhaust guide has a plurality of second openings connected to said exhaust path.

2. An electric cleaning device comprising:

a main cleaning device unit;

an electric blower holding chamber in the main unit, said chamber containing an electric blower;

a flexible hose connected to the main unit, said hose having an outer hose section and a spaced apart inner hose section, the inner section providing a suction path, the space between the outer and inner sections providing an exhaust path;

an extension pipe selectively connected to said hose;

a floor intake tool connected to said pipe;

a suction path from said blower to said tool to suction air from said tool to said blower;

integral exhaust guide connected at one end to the blower to receive exhaust air from the blower;

an exhaust path for guiding exhaust from said guide to said hose; and a second exhaust path from said hose through said pipe to said tool.

3. An electric cleaning device as recited in claim 1 wherein:

said exhaust guide is flexible; and a connecting section on said exhaust guide is fitted to said opening and said communicating opening.

4. An electric cleaning device comprising a main cleaning device unit:

an electric blower unit in said main cleaning device unit;

a flexible hose connected to said main cleaning device; said hose having an outer hose section and a spacedapart inner hose section, the inner section providing a suction path, the space between the outer and inner sections providing an exhaust path;

an extension pipe selectively connected to said hose;

a floor intake tool connected to said pipe;

a suction path from said blower unit to said tool to suction air from said tool to said blower unit;

an exhaust path from said blower unit to said tool;

the exhaust path including an exhaust portion from said blower unit;

an integral exhaust guide connected at one end to said blower unit to receive exhaust air from said blower unit;

a second end of the exhaust guide connected to said exhaust path; and a motor case surrounding said blower unit; a section of said case surrounding said blower unit and said exhaust guide forming an integral structure.

* * * * *